US008567486B1

(12) United States Patent
Wolf, Sr.

(10) Patent No.: US 8,567,486 B1
(45) Date of Patent: Oct. 29, 2013

(54) RESERVOIR SYSTEMS INCLUDING FLOW DIRECTIONAL DEVICES, HEAT TRANSFER SYSTEMS INCLUDING RESERVOIR SYSTEMS AND RELATED METHODS

(75) Inventor: David A. Wolf, Sr., Baltimore, MD (US)

(73) Assignee: Alliant Techsystems Inc., Arlington, VA (US)

( * ) Notice: Subject to any disclaimer, the term of this patent is extended or adjusted under 35 U.S.C. 154(b) by 840 days.

(21) Appl. No.: 11/690,110

(22) Filed: Mar. 22, 2007

Related U.S. Application Data

(60) Provisional application No. 60/743,651, filed on Mar. 22, 2006.

(51) Int. Cl.
*F28F 27/00* (2006.01)
*F28D 15/00* (2006.01)

(52) U.S. Cl.
USPC ..... 165/274; 165/272; 165/104.22

(58) Field of Classification Search
USPC ..... 165/104.22, 272, 273, 274; 62/49.2, 81, 62/85
See application file for complete search history.

(56) References Cited

U.S. PATENT DOCUMENTS

| | | | | |
|---|---|---|---|---|
| 2,776,092 | A * | 1/1957 | Collins, Jr. | 165/274 |
| 3,146,602 | A * | 9/1964 | Swearingen | 62/85 |
| 3,298,431 | A * | 1/1967 | Weaver | 165/274 |
| 3,327,772 | A * | 6/1967 | Kodaira | 165/273 |
| 3,404,730 | A * | 10/1968 | Kurisu | 165/272 |
| 3,756,903 | A * | 9/1973 | Jones | 165/274 |
| 3,837,175 | A * | 9/1974 | Miller | 62/81 |
| 4,026,348 | A * | 5/1977 | Roberts, Jr. | 165/272 |
| 4,061,131 | A * | 12/1977 | Bohanon | 165/104.22 |
| 4,128,123 | A * | 12/1978 | Garriss et al. | 165/274 |
| 4,308,912 | A * | 1/1982 | Knecht | 165/274 |
| 4,314,601 | A * | 2/1982 | Giuffre et al. | 165/274 |
| 4,745,906 | A * | 5/1988 | DeBeni et al. | 165/104.22 |
| 4,917,173 | A * | 4/1990 | Brown et al. | 165/274 |
| 5,103,897 | A * | 4/1992 | Cullimore et al. | 165/274 |
| 6,220,341 | B1 * | 4/2001 | Izumi et al. | 165/274 |
| 6,435,274 | B1 * | 8/2002 | Weislogel | 165/274 |
| 6,491,812 | B2 * | 12/2002 | Pang | 62/49.2 |
| 6,810,946 | B2 | 11/2004 | Hoang | |
| 6,889,754 | B2 | 5/2005 | Kroliczek | |
| 6,948,556 | B1 | 9/2005 | Anderson | |
| 7,004,240 | B1 | 2/2006 | Kroliczek | |
| 2005/0061487 | A1 | 3/2005 | Kroliczek | |
| 2007/0199339 | A1 * | 8/2007 | Ishihara et al. | 165/274 |

OTHER PUBLICATIONS

"Development of an Advanced Capillary Pumped Loop," Triem T. Hoang et al., Society of Automotive Engineers, 27th Environmental Systems International Conference, Jul. 14-17, 1997, 6 pages.

"Development of Two-Phase Capillary Pumped Heat Transport for Spacecraft Central Thermal Bus," T. Hoang et al., Space Technology and Applications International Forum—STAIF 2003, pp. 49-54, American Institute of Physics, 2003.

* cited by examiner

*Primary Examiner* — Ljiljana Ciric
(74) *Attorney, Agent, or Firm* — TraskBritt

(57) ABSTRACT

A heat transfer system includes a primary evaporator, a condenser to the primary evaporator by a liquid line and a vapor line, a secondary evaporator connected to the primary evaporator through a sweepage line, and a reservoir system. The reservoir system includes a reservoir, a first flow directional device that restricts fluid from flowing into the reservoir from the primary evaporator, and a second flow directional device that restricts fluid from flowing out of the reservoir through at least one output of the reservoir.

41 Claims, 17 Drawing Sheets

RESERVOIR SYSTEMS INCLUDING FLOW DIRECTIONAL DEVICES, HEAT TRANSFER SYSTEMS INCLUDING RESERVOIR SYSTEMS AND RELATED METHODS

CROSS-REFERENCE TO RELATED APPLICATION

This application claims priority to U.S. Provisional Application No. 60/743,651, filed on Mar. 22, 2006, which is incorporated herein by reference in its entirety.

TECHNICAL FIELD

This description relates to a system for heat transfer.

BACKGROUND

Heat transfer systems are used to transfer heat from one location (the heat source) to another location (the heat sink). Heat transfer systems can be used in terrestrial or extraterrestrial applications. For example, heat transfer systems may be integrated into satellite equipment that operates within zero- or low-gravity environments. As another example, heat transfer systems can be used in electronic equipment, which often requires cooling during operation.

Loop Heat Pipes (LHPs) and Capillary Pumped Loops (CPLs) are passive two-phase heat transfer systems. Each include an evaporator thermally coupled to the heat source, a condenser thermally coupled to the heat sink, fluid that flows between the evaporator and the condenser, and a fluid reservoir for expansion of the fluid. The fluid within the heat transfer system may be referred to as the working fluid. The evaporator includes a primary wick and a core that includes a fluid flow passage. Heat acquired by the evaporator is transported to and discharged by the condenser. These systems utilize capillary pressure developed in a fine-pored wick within the evaporator to promote circulation of working fluid from the evaporator to the condenser and back to the evaporator. The primary distinguishing characteristic between an LHP and a CPL is the location of the loop's reservoir, which is used to store excess fluid displaced from the loop during operation. In general, the reservoir of the CPL is located remotely from the evaporator, while the reservoir of an LHP is co-located with the evaporator.

Hybrid loops are two-phase heat transfer systems in which sweepage can be accomplished with a mechanical pump or passively through the use of a secondary (or auxiliary) evaporator.

SUMMARY

Supplying liquid for vaporization to each evaporator within a two-phase heat transfer system can promote robust operation of the system by sweeping vapor and non-condensable gas (NCG) bubbles that can form in the core of each evaporator.

In one general aspect, a heat transfer system includes a primary evaporator, a condenser coupled to the primary evaporator by a liquid line and a vapor line, a secondary evaporator connected to the primary evaporator through a sweepage line, and a reservoir system. The reservoir system includes a reservoir, a first flow directional device that restricts fluid flow such that fluid flows into the reservoir from the primary evaporator, and a second flow directional device that restricts fluid flow such that fluid flows out of the reservoir through at least one output of the reservoir.

Implementations can include one or more of the following features. The first flow directional device can include a first valve and the second flow directional device can include a second valve. One or more of the first valve and the second valve can be one-way check valves. One or more of the first valve and the second valve can be gate valves. One or more of the first and second flow directional devices can be external to a body of the reservoir. One or more of the first and second flow directional devices can be internal to a body of the reservoir.

The primary evaporator can include a liquid inlet port coupled to the liquid line, a vapor outlet port coupled to the vapor line, and a fluid outlet port coupled to the first flow directional device, and the fluid outlet coupled to a liquid channel of the primary evaporator. The fluid outlet port can includes a first outlet configured to remove at least vapor from the primary evaporator, and a second outlet configured to remove fluid from the primary evaporator. A capillary barrier can separate the first outlet of the fluid output port from the second outlet of the fluid output port. The capillary barrier can be a wick or a screen.

The heat transfer system also can include a mechanical pump coupled to an output of the condenser and the liquid inlet of the primary evaporator, the mechanical pump being configured to receive excess fluid from the condenser and to provide excess fluid to the primary evaporator. The mechanical pump can be positioned in series with the liquid line. The mechanical pump can be positioned between the condenser and the reservoir system. The heat transfer system also can include a bypass line configured to direct fluid around the mechanical pump, the bypass line including a first side, a second side, and a bypass device, where the first side is coupled upstream of a fluid entrance of the mechanical pump, the second side is coupled downstream of a fluid exit of the mechanical pump, and the bypass device is configured to control fluid flow through the bypass line. The bypass device can include a switch. The switch can be a check valve.

The heat transfer system also can include a power source configured to apply power to the secondary evaporator such that excess fluid flow is provided to the primary evaporator and the secondary evaporator.

The heat transfer system also can include at least one of the first flow directional device and the second flow directional device, an open/close valve, and a feedback system coupled to the open/close valve to control operation of the open/close valve. The feedback system can include a sensing system coupled to the at least one of the first flow directional device and the second flow directional device for sensing a value associated with fluid flow through the at least one of the first flow directional device and the second flow directional device, and an actuator configured to operate the open/close valve in response to a signal from the sensing system. The open/close valve can include a gate valve. The sensing system can sense a pressure difference of the fluid at the at least one of the first flow directional device and the second flow directional device, and the actuator can operate in response to the signal indicating that the sensed pressure difference is greater than a predetermined value.

The heat transfer system also can include a second primary evaporator. The second primary evaporator can include a liquid inlet, and the liquid inlet of the second primary evaporator can be coupled to the fluid outlet of the primary evaporator through a sweepage line. The liquid inlet of the second primary evaporator can be coupled to the liquid line.

In another general aspect, a method for heat transfer includes sweeping fluid from an evaporator to a first port of a reservoir, limiting fluid from flowing from the evaporator into the reservoir through the first port, discharging liquid from a second port of the reservoir, and limiting liquid flowing away from the reservoir through at least the second port.

Implementations can include one or more of the following features. Sweeping fluid from the evaporator can include sweeping one or more of vapor and non-condensable gas bubbles from the evaporator. Limiting fluid flow in a single direction to the reservoir first port can include flowing fluid through a first check valve positioned outside a body of the reservoir and coupled to the first port of the reservoir. Limiting liquid flow from the reservoir second port can include flowing fluid through a second check valve positioned outside a body of the reservoir and coupled to the second port of the reservoir. Limiting fluid flow in a single direction to the reservoir first port can include flowing fluid through a first check valve positioned inside a body of the reservoir and coupled to the first port of the reservoir. Limiting fluid flow in a single direction from the reservoir second port can include flowing fluid through a second check valve positioned inside a body of the reservoir and coupled to the second port of the reservoir.

The method also can include supplying liquid from the condenser to a liquid inlet of a primary evaporator, where the primary evaporator can be connected to the condenser through a liquid line. Vapor can be discharged from a vapor outlet of the primary evaporator to a vapor line connected to the condenser, a secondary evaporator fluidly coupled to the reservoir can be heated such that liquid is swept from a fluid outlet port of the primary evaporator to a fluid inlet of the reservoir, and vapor can be discharged from the secondary evaporator into the vapor line. The fluid can be swept from the condenser to the primary evaporator by a mechanical pump. The fluid can be swept from the fluid outlet of the primary evaporator by a mechanical pump.

In another general aspect, a fluid reservoir system includes a reservoir having a body for holding fluid, a first flow directional device configured to limit fluid from flowing into the body of the reservoir, and a second flow directional device configured to limit fluid from flowing away from the body of the reservoir.

Implementations can include one or more of the following features. The first flow directional device can be inside the body of the reservoir. The second flow directional device can be inside the body. The first flow directional device can be outside the body. The second flow directional device can be outside the body. The first and second flow directional devices can be one-way check valves. The first flow directional device can be configured such that fluid flows into the reservoir through a first port coupled to the body, and the second flow directional device is configured such that fluid flows out of the reservoir through a second port coupled to the body.

DETAILED DESCRIPTION

Figure 1:
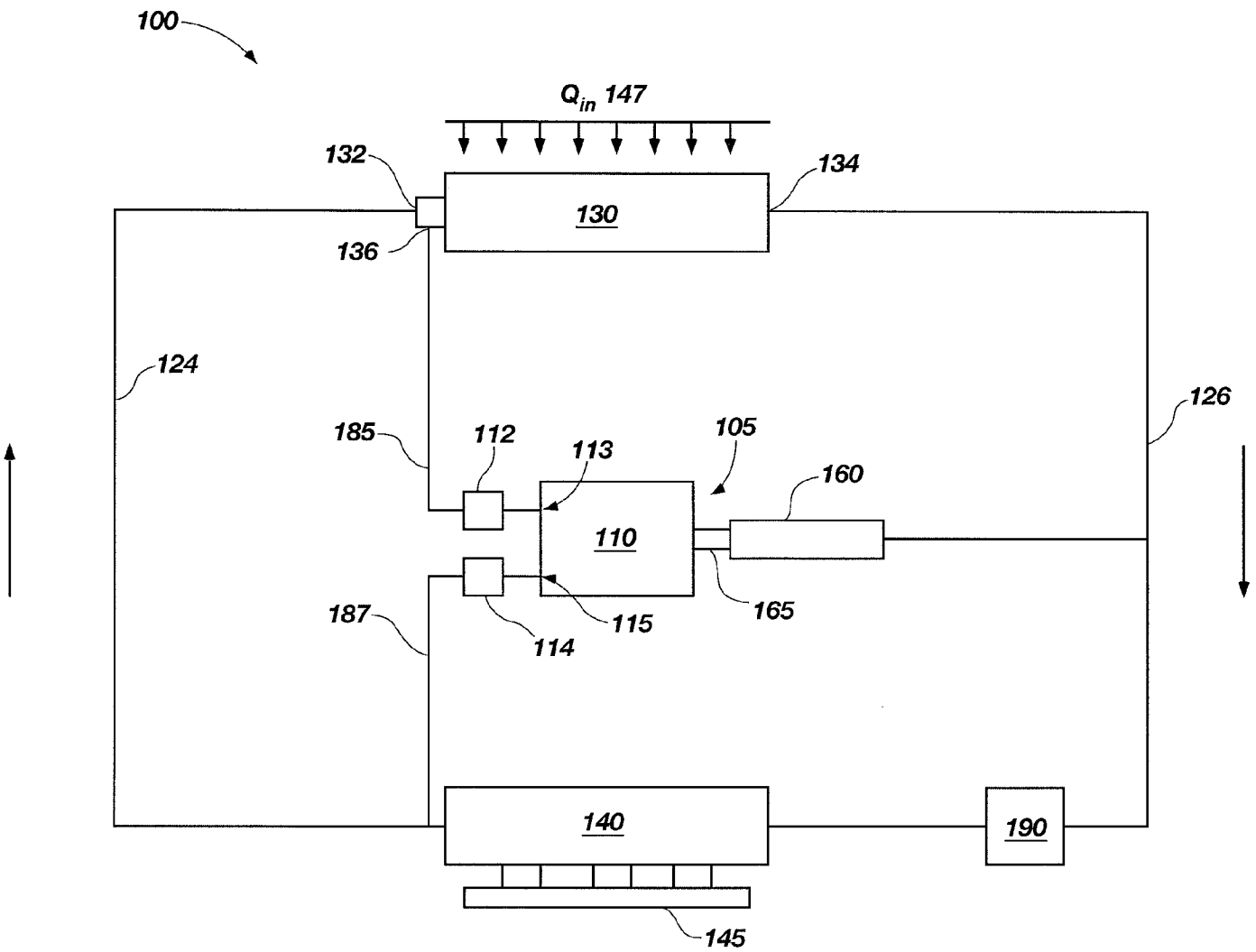
FIG. 1 is a block diagram of a heat transfer system.

Referring to FIG. 1, a heat transfer system 100 includes a reservoir system 105, which accommodates changes in the volume of fluid within the heat transfer system 100. Fluid can include liquid, vapor, and/or non-condensable gas. The reservoir system 105 includes a reservoir 110, a flow-directional device 112, a first port 113, a flow-directional device 114, and a second port 115. The heat transfer system 100 also includes a primary evaporator 130 that includes a liquid inlet 132, a vapor outlet 134, and a fluid outlet 136. The heat transfer system 100 also includes a condenser 140, which is coupled to the primary evaporator 130 by a liquid line 124 and a vapor line 126. The condenser 140 is in thermal communication with a heat sink 145, and the primary evaporator 130 is in thermal communication with a heat source $Q_{in}$ 147. The liquid inlet 132 is coupled to the liquid line 124, and the vapor outlet 134 is coupled to the vapor line 126. The fluid outlet 136 from the evaporator 130 is coupled to a sweepage line 185 which fluidly couples to the flow-directional device 112. A sweepage evaporator 160 (which also may be referred to as a secondary evaporator or an auxiliary evaporator) can be co-located with the reservoir 110. In some implementations, the sweepage evaporator 160 is fluidly and thermally coupled to the reservoir 110 through a conduit 165. The sweepage evaporator 160 is coupled to the vapor line 126. The reservoir 110 can be cold biased such that non-condensable gas (NCG) accumulates in the reservoir 110 or vapor present in the reservoir 110 can be condensed into liquid. The reservoir 110 can be cold biased by, for example, coupling a thermo-electric cooler to the reservoir 110, by thermally coupling a heat sink to the reservoir 110, or by the way described in more detail below with respect to FIG. 9.

The reservoir system 105 includes the flow-directional devices 112 and 114, which are configured to allow fluid to flow in only one direction relative to the reservoir 110. In particular, the flow-directional device 112 restricts fluid flow such that fluid flows into the reservoir 110 from the fluid outlet 136 of the primary evaporator 130, and the flow-directional device 114 restricts fluid flow such that fluid flows out of the reservoir 110 through a sweepage line 187 to the liquid line 124. In some implementations, such as the implementation shown in FIG. 12, the sweepage line 187 connects to the vapor line 126 between the condenser 140 and a back pressure regulator (BPR) 190. The BPR 190 ensures that no vapor enters the condenser 140 unless the vapor space of the evaporator 130 is void of liquid. In other implementations, the sweepage line 187 can fluidly couple to the condenser 140.

The flow-directional devices 112 and 114 can be passive devices, such as one-way check valves that allow fluid having a minimum upstream pressure (e.g., the cracking pressure, which is the upstream pressure at which flow through the valve begins) to flow through the valve in only one direction. One suitable check valve is the 50 Series Check Valve made by SWAGELOK® of Solon, Ohio. Another suitable check valve is the C Series Check Valve, also made by SWAGELOK® of Solon, Ohio. One suitable active valve is available from Tias Ltd. of 141400 Russia, Moscow Region, Khimky Engelsa 21/1.

Figure 2A:
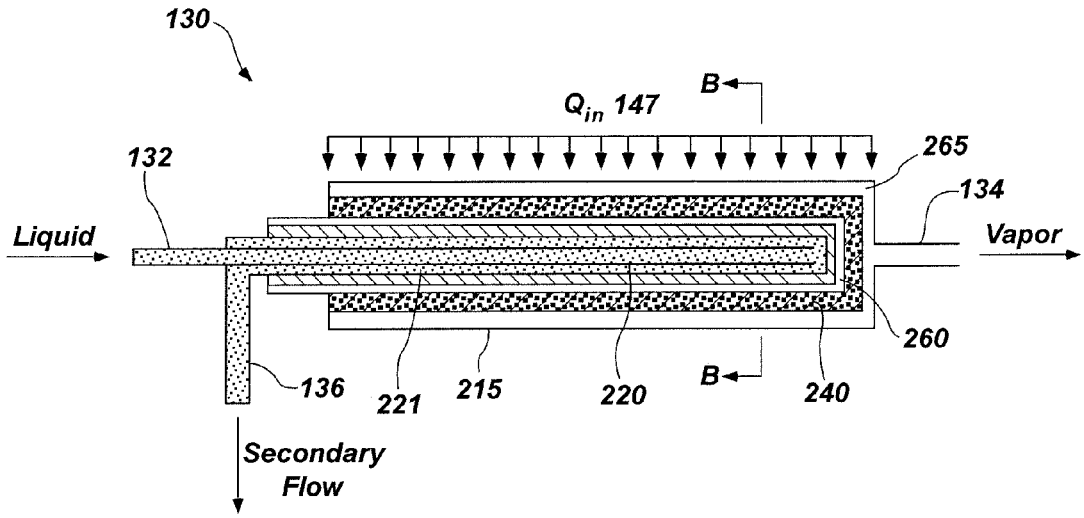
FIG. 2A is a cross-sectional view of a three-port evaporator that can be used in the heat transfer systems of FIGS. 1, 5-9, 11, and 12.
Figure 2B:
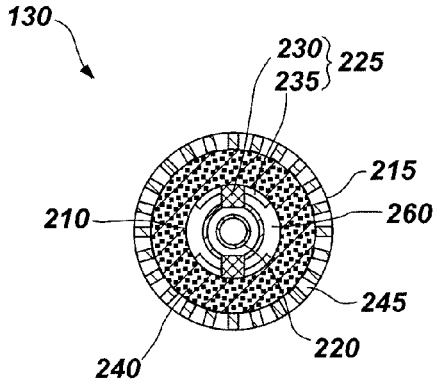
FIG. 2B is a cross-sectional view taken along section line B-B of the evaporator of FIG. 2A.

Referring also to FIGS. 2A and 2B, the primary evaporator 130 can be a three-port evaporator that includes the liquid inlet 132, the vapor outlet 134, and the fluid outlet 136. Generally, in the three-port evaporator 130, liquid flows into the fluid inlet 132 into a core 210, which is defined by a primary wick 240, and fluid from the core 210 flows from the fluid outlet 136 to the reservoir 110. The fluid and the core 210 are housed within a container 215 made of, for example, aluminum. In particular, fluid flowing from the liquid inlet 132 into the core 210 flows through a bayonet tube 220, into a liquid passage 221 that flows through and around the bayonet tube 220. Fluid can flow through a secondary wick 225 made of a wick material 230 and an annular artery 235. The wick material 230 separates the annular artery 235 from a first vapor passage 260. As power from the heat source $Q_{in}$ 147 is applied to the evaporator 130, liquid from the core 210 enters the primary wick 240 and evaporates, forming vapor that is free to flow along a second vapor passage 265 that includes one or more vapor grooves 245. Vapor flows out of the evaporator 130 through the vapor outlet 134 and into the vapor line 126. Vapor bubbles that form within first vapor passage 260 of the core 210 are swept out of the core 210 through the first vapor passage 260 and into the fluid outlet 136. As discussed above, vapor bubbles within the first vapor passage 260 can pass through the secondary wick 225 if the pore size of the secondary wick 225 is large enough to accommodate the vapor bubbles. Alternatively, or additionally, vapor bubbles within the first vapor passage 260 can pass through an opening of the secondary wick 225 formed at any suitable location along the secondary wick 225 to enter the liquid passage 221 or the fluid outlet 136.

Figure 2C:
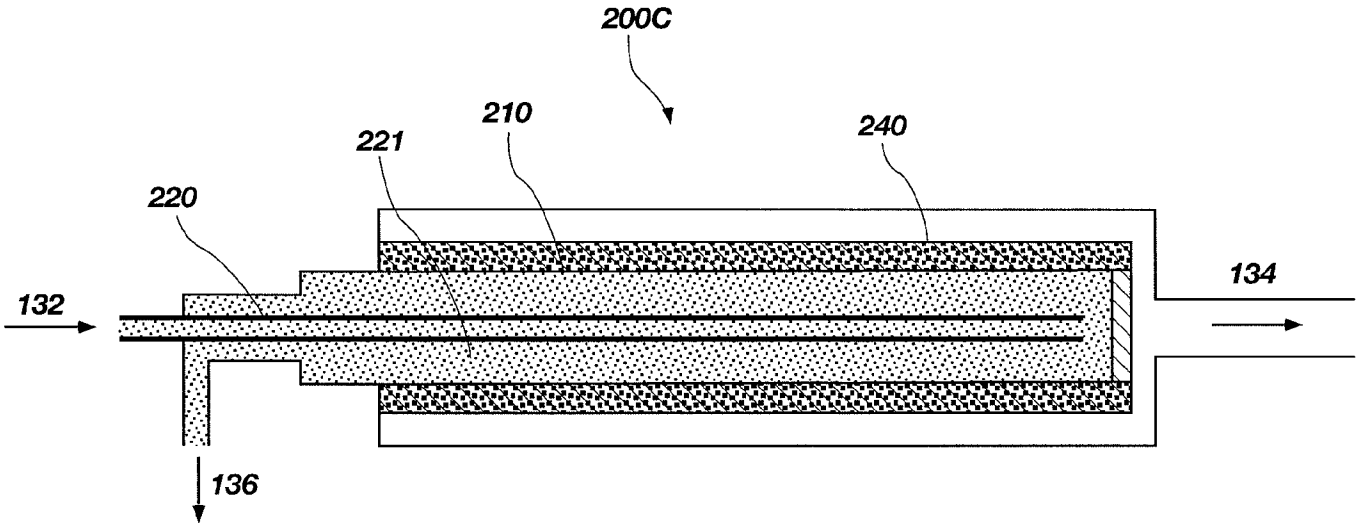
FIG. 2C is a cross-sectional view of a three-port evaporator that can be used in the heat transfer systems of FIGS. 1, 5-9, 11, and 12.

Other evaporator designs can be used as the primary evaporator 130. Referring to FIG. 2C, the evaporator 130 (FIGS. 1, 2A and 2B) can be a three-port evaporator 200C that includes the liquid inlet 132, the vapor outlet 134, and the fluid outlet 136. Similar to the design shown in FIG. 2A, liquid flows into the fluid inlet 132 into a core 210, which is defined by a primary wick 240, and fluid from the core 210 flows from the fluid outlet 136 to the reservoir 110. Fluid flowing from the liquid inlet 132 into the core 210 flows through a bayonet tube 220, into a liquid passage 221 the flows through and around the bayonet tube 220. However, the evaporator 200C does not include a secondary wick.

Figure 2D:
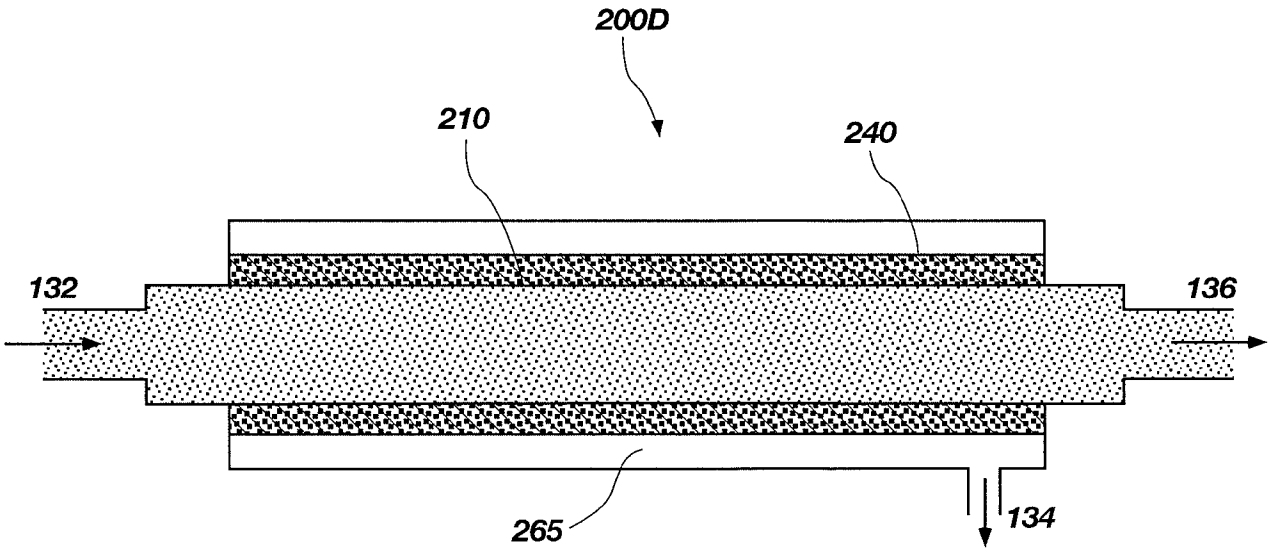
FIG. 2D is a cross-sectional view of a three-port evaporator that can be used in the heat transfer systems of FIG. 1, 5-9, 11, and 12.

Referring to FIG. 2D, in another implementation, the evaporator 130 (FIGS. 1, 2A and 2B) can be a flow-through three-port evaporator such as the evaporator 200D. The evaporator 200D is similar to the evaporator 200C, except it does not include the bayonet tube 220. In this implementation, liquid flows in through the liquid inlet 132 and into the core 210 defined by a primary wick 240. As power from the heat source $Q_{in}$ 147 (FIG. 1) is applied to the evaporator 200D, liquid from the core 210 enters the primary wick 240 and evaporated, forming vapor that is free to flow along a vapor passage 265. Vapor flows out of the evaporator 200D through the vapor outlet 134 and into the vapor line 126 (FIG. 1). Fluid remaining in the core 210 flows out of the fluid outlet 136 into the sweepage line 185 (FIG. 1).

Figure 3:
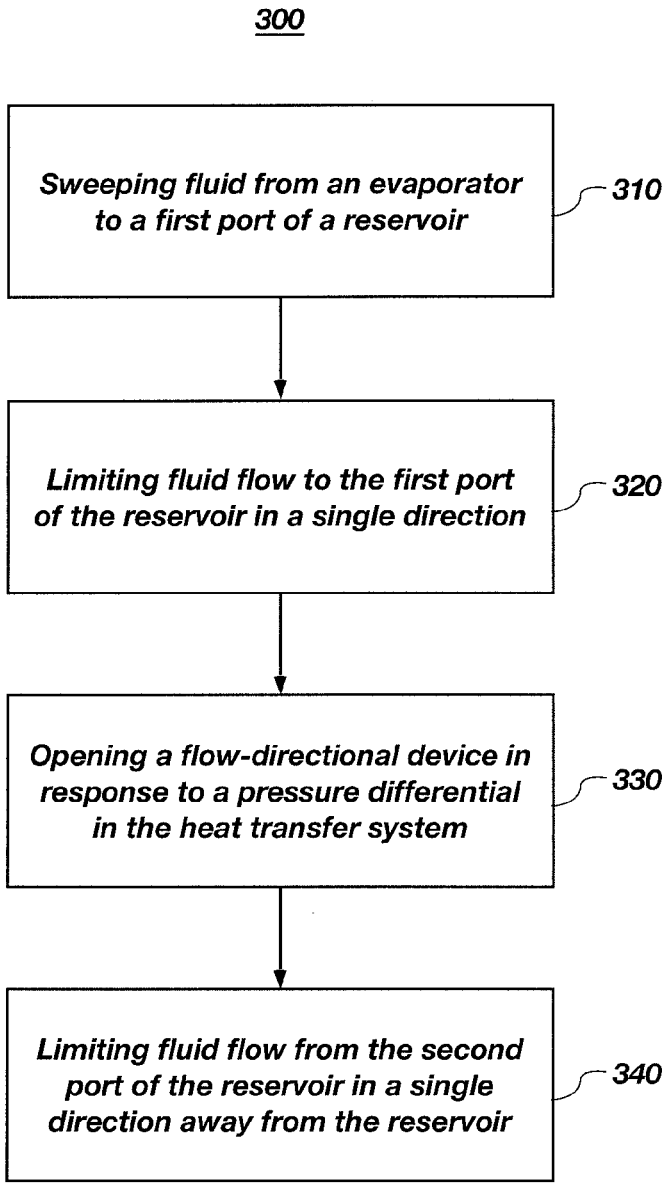
FIG. 3 is a flowchart of a procedure for maintaining fluid flow during a transient in the heat transfer systems of FIG. 1, 5-9, 11, and 12.

Referring to FIG. 3, with continued reference to FIG. 1, a procedure 300 is performed to provide sufficient fluid to be condenser 140 during transients such that fluid can be provided uninterrupted to the evaporator 130.

Initially, fluid (which can include liquid, vapor, and/or non-condensable gas) is swept from the evaporator 130 through the sweepage line 185 to the flow-directional device 112 (step 310). The flow-directional device 112 prevents the fluid from flowing back to the evaporator 130 and permits the fluid to flow toward a first port 113 of the reservoir 110 (step 320).

During a transient, the pressure in the condenser 140 can be lower than the pressure of the reservoir 110. This pressure difference causes the flow-directional device 114 to open such that fluid that has been swept into the reservoir 110 can be discharged from the second port 115 of the reservoir 110 (step 330). The liquid is discharged from the second port 115 of the reservoir 110 away from the reservoir 110 (step 340) and to the flow-directional device 114. In this way, the liquid discharged from the second port 115 of the reservoir 110 is limited to flowing in a single direction such that the liquid from the second port 115 flows into the liquid line 124, or the vapor line 126, and is prevented from flowing back into the second port 115 of the reservoir 110.

The procedure 300 can be used to sweep non-condensable gas (NCG) bubbles or vapor formed in the core 210 of the evaporator 130 by providing the evaporator 130 with excess fluid flow, for example, during transients. As described above with respect to FIGS. 2A and 2B, the core 210 of the evaporator 130 is defined by a wick 240. Liquid from the core 210 enters the wick 240 and evaporates, forming a vapor that flows out of a vapor outlet 134 of the evaporator 130 and into the vapor line 126 (FIG. 1). However, NCG bubbles or vapor can form in the core 210 of the evaporator 130, and the NCG bubbles or vapor can prevent liquid for vaporization from being supplied to the evaporator 130. For example, heat conducted across the wick 240 of the evaporator 130 (e.g., from the heat source $Q_{in}$ 147 (FIG. 1)) can create bubbles and/or cause existing bubbles to expand. Bubbles that expand can become large enough to block the liquid flow in the core 210 of the evaporator 130.

One approach to managing the bubbles is to provide excess fluid flow to the evaporator 130 such that the bubbles that form in the core 210 are swept through the evaporator 130 by the excess fluid, and, thus, are not able to accumulate in areas where the bubbles can inhibit liquid flow to the wick 240. However, guaranteeing excess fluid flow under all conditions can be challenging, particularly during power and sink temperature transients. In particular, if the sweepage line 185 is the only flow path connecting the reservoir 110 to the heat transfer system 100, fluid flow to the evaporator 130 can be interrupted during transients. These interruptions can result in fluid flow that is insufficient for sweeping bubbles from the evaporator core 210.

During steady-state operation of the heat transfer system 100, there is no net fluid exchange between the reservoir 110 and the remainder of the heat transfer system 100. In steady state, liquid in the reservoir 110 is pulled into the evaporator 160, where it is evaporated and exits the evaporator 160 to the vapor line 126. However, during a transient (e.g., when the heat load is reduced or the sink temperature decreases), the reservoir 110 discharges liquid in order to maintain a constant or nearly-constant operating temperature in the heat transfer system 100. The transients can cause the condenser 140 to have insufficient fluid, which results in the condenser 140 having a lower pressure compared to the other parts of the heat transfer system 100. The pressure differences (e.g., the pressure in the condenser 140 can be lower than that of the reservoir 110) in the heat transfer system 100 during the transient event causes liquid in the reservoir 110 to discharge through the sweepage line 187 and the flow-directional device 114. This allows sweepage flow to continue uninterrupted through the flow-directional device 112 from the core 210.

Figure 4:
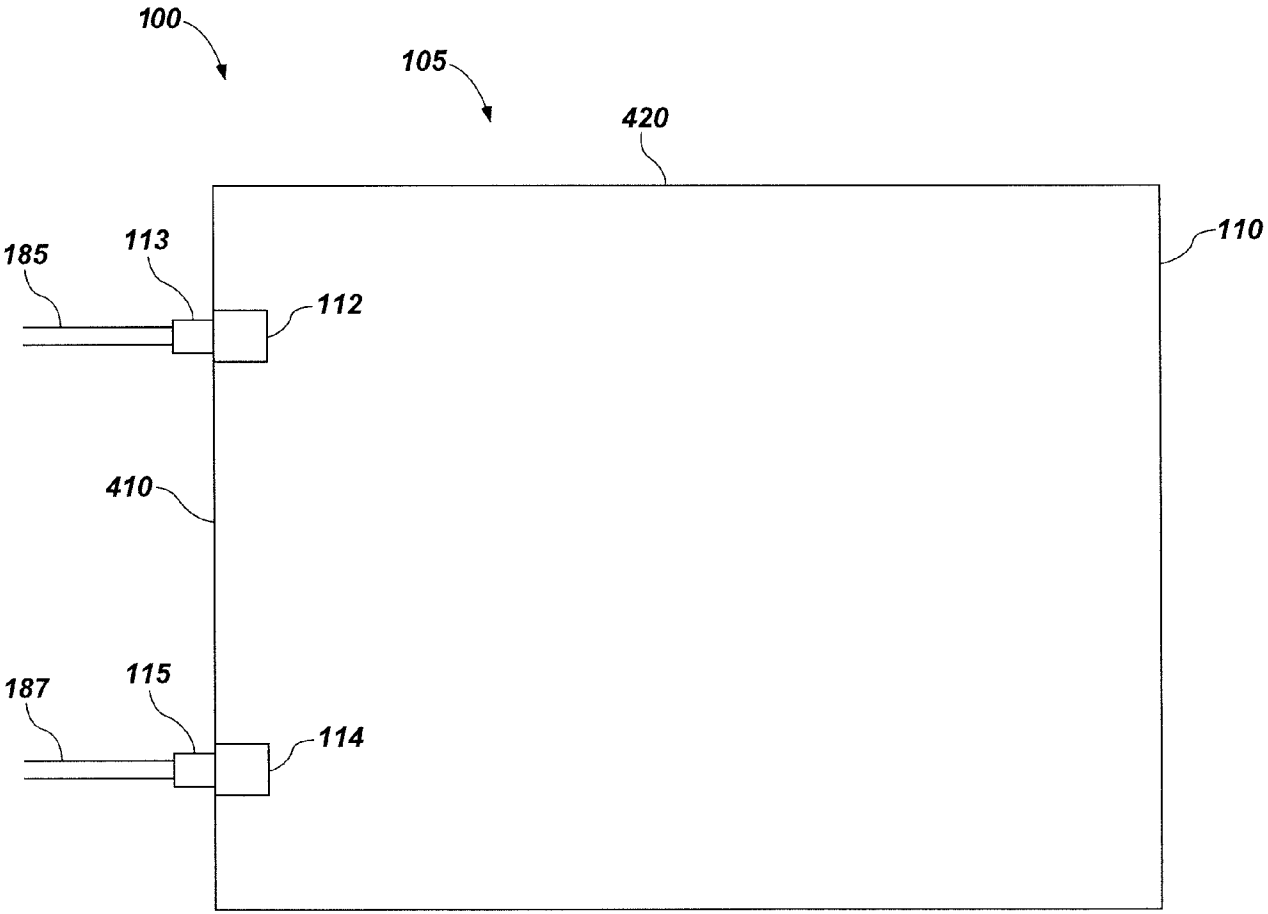
FIG. 4 is a block diagram of a reservoir system that can be used in the heat transfer systems of FIGS. 1, 5-9, 11, and 12.

Referring to FIG. 4, in another implementation, a reservoir system 105 includes the reservoir 110, the flow-directional device 112, and the flow-directional device 114. The reservoir system 105 accommodates redistribution or volume changes of the fluid within the heat transfer system 100 by replenishing fluid to the heat transfer system 100 and holding fluid for the heat transfer system 100. As discussed above, the flow-directional device 112 is configured to allow fluid to flow into the reservoir 110, and the flow-directional device 114 is configured to allow fluid to flow out of the reservoir 110. The input port 113 enables fluid to flow into the reservoir 110 by coupling the reservoir 110 to the sweepage line 185. Similarly, the output port 115 enables fluid to flow out of the reservoir 110 by coupling the reservoir 110 to the sweepage line 187.

In another implementation, and referring to FIG. 4, the flow-directional devices 112 and 114 are internal to and integral with the reservoir 110. In the implementation shown in FIG. 4, the input port 113 and the output port 115 are integral with the reservoir 110 and protrude from a first surface 410 of the reservoir 110. In the implementation shown in FIG. 4, the input port 113 and the output port 115 are both located on the surface 410. However, the input port 113 and the output port 115 can be located on any surface of the reservoir 110. For example, the input port 113 and the output port 115 can be located on a second surface 420 of the reservoir 110, or any other surface of the reservoir 110. The input port 113 and the output port 115 can be located on different surfaces of the reservoir 110. For example, the input port 113 can be located on the second surface 420 and the output port 115 can be located on the first surface 410.

As discussed above, the flow-directional devices 112 and 114 can be passive devices, such as check valves, that only allow fluid to flow in one direction. The flow-directional devices 112 and 114 also can be open/close valves that open or close to enable or block the flow of fluid. In the design shown in FIG. 4, the flow-directional devices 112 and 114 are sealed into the reservoir 110 and coupled to the input port 113 and output port 115, respectively. In another design, the flow-directional devices 112 and 114 can be inside of the reservoir 110. In this implementation, the flow-directional devices 112 and 114 are in contact with the input port 113 and the output port 115, respectively, such that the flow-directional device 112 receives fluid from the input port 113 and the flow-directional device 114 couples fluid to the output port 115.

Other designs are possible. For example, the flow-directional devices 112 and 114 can be external to and separate from the reservoir 110, such as in the implementation shown in FIG. 1. The flow-directional devices 112 and 114 can be external to the reservoir 110 and integral with the reservoir 110. For example, the flow-directional device 112 can be integral with the input port 113 and/or the flow-directional device 114 can be integral with the output port 115. The input port 113 can be external to the reservoir 110 and the output port 115 can be internal to the reservoir 110, or vice versa.

In other implementations, the input port 113 and the output port 115 are flush with the surface 410 of the reservoir 110. In this implementation, the input port 113 and the output port 115 can penetrate the surface 410 of the reservoir 110 such that the sweepage lines 185 and 187 extend into the reservoir 110.

Figure 5:
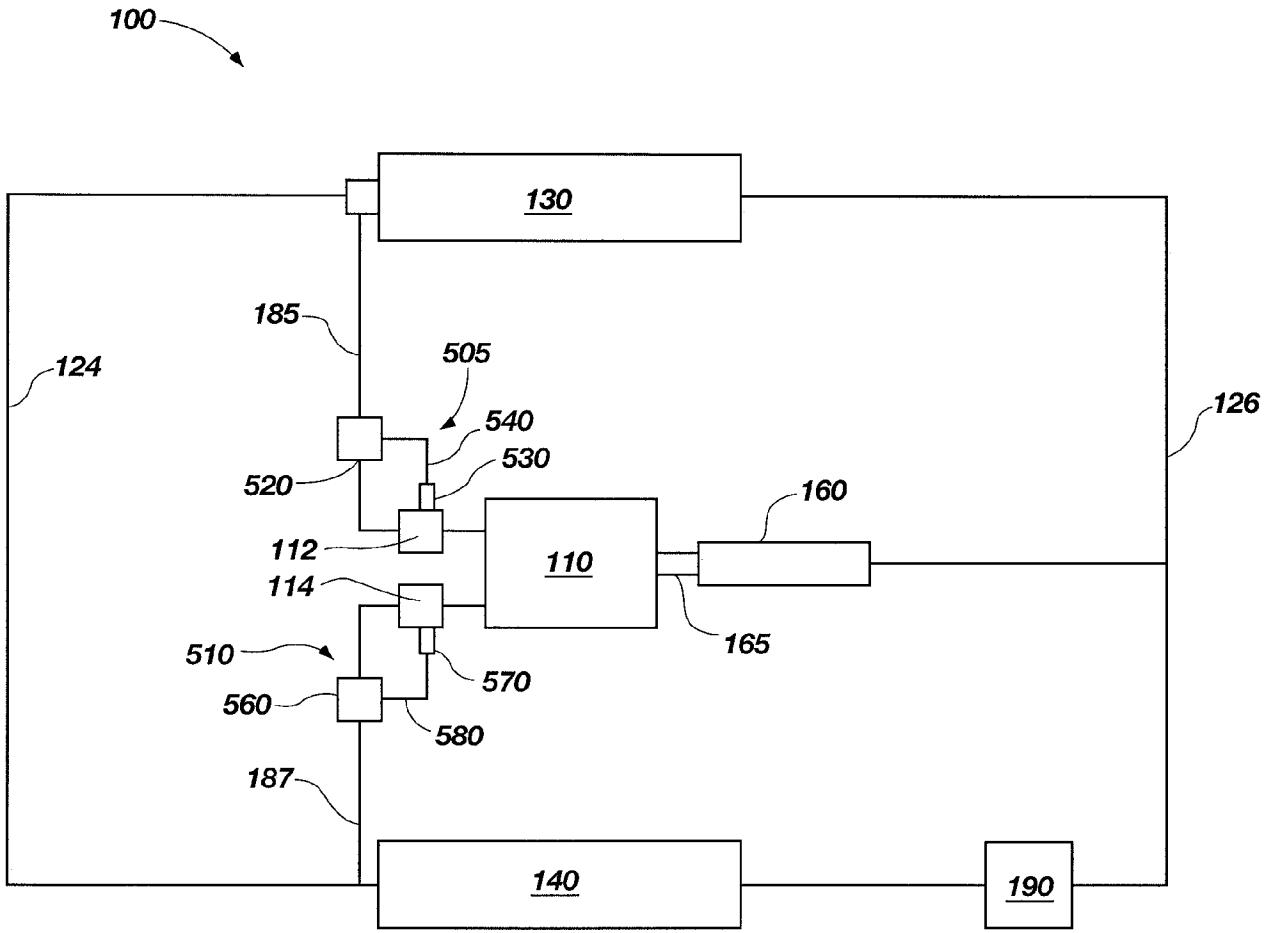
FIG. 5 is a block diagram of a heat transfer system that includes a feedback system.

Referring to FIG. 5, in another implementation, the heat transfer system 100 includes feedback systems 505 and 510 that are coupled to and control the flow-directional devices 112 and 114, respectively. The feedback system 505 is coupled to the flow-directional device 112 and controls the operation of the flow-directional device 112. In particular, the feedback system 505 is configured to control the opening and closing of the flow-directional device 112 to permit or restrict fluid flow through the flow-directional device 112. Similarly, the feedback system 510 controls the opening and closing of the flow-directional device 114.

The feedback system 505 includes a sensing system 520, and actuator 530, and a feedback loop 540. The sensing system 520 is coupled to the sweepage line 185. The sensing system 520 is configured to sense a pressure of the fluid included in the sweepage line 185 relative to the pressure of the fluid in the reservoir 110 and to produce a signal representing the pressure difference. The sensing system 520 can sense other properties related to the heat transfer system 100. For example, the sensing system 520 can sense a pressure of the fluid in the sweepage line 185, a temperature of the fluid in the sweepage line 185, and/or a flow rate of the fluid in the sweepage line 185. In another example, the sensing system 520 can sense the temperature of the reservoir 110 and the temperature of the condenser 140.

The signal produced by the sensing system 520 is communicated to the actuator 530 though the feedback loop 540. The feedback loop 540 can connect the sensing system 520 and the actuator 530 through a physical connection, such as a wire or an optical fiber, or it can connect the sensing system 520 and the actuator 530 through a wireless connection. For example, the feedback loop 540 can transmit the sensed signal from the sensing system 520 from an optical or radio frequency (RF) transmitter on the sensing system 520 to an optical receiver on the actuator 530.

The actuator 530 operates the opening and closing of the flow-directional device 112 in response to the signal from the sensing system 520. For example, the actuator 530 can be configured to open a valve in the flow-directional device 112 to enable fluid to flow through the flow directional device 112 in response to receiving a signal indicating that the pressure of the fluid in the sweepage line 185 relative to the pressure in the reservoir 110 is above a predefined value.

The feedback system 510 controls the flow-directional device 114. The feedback system 510 includes a sensing system 560 and an actuator 570 that communicate through a feedback loop 580. The sensing system 560, the actuator 570, and the feedback loop 580 can include the same type of components and functionality as the sensing system 520, the actuator 530, and the feedback loop 540.

In another design, the sensing systems 520 and 560 sense the temperature of the reservoir 110 and the condenser 140. In this design, the flow-directional devices 112 and 114 can be active valves that are electronically controlled. Each active valve can include bellows within the valve, and the bellows can be surrounded by a fluid. The bellows can receive fluid from the sweepage lines 185 and 187, respectively. Heating or cooling of the active valve changes the saturation pressure of the fluid outside of the bellows and causes the bellows to expand or collapse, and the motion of the bellows controls the valve setting to impact the flow through the valve. For example, the bellows can be connected to a plunger, which can extend into the sweepage lines 185 or 187 when the bellows collapse, thus blocking the flow of fluid through the sweepage lines 185 and 187. In one implementation, the flow directional device 112 can open to allow fluid to flow through the sweepage line 185 when the temperature of the condenser 140 is higher than the temperature of the reservoir 110. When the temperature of the reservoir 110 is higher than the temperature of the condenser 140, the flow directional device 114 can open to allow fluid to flow through the sweepage line 187.

Figure 6A:
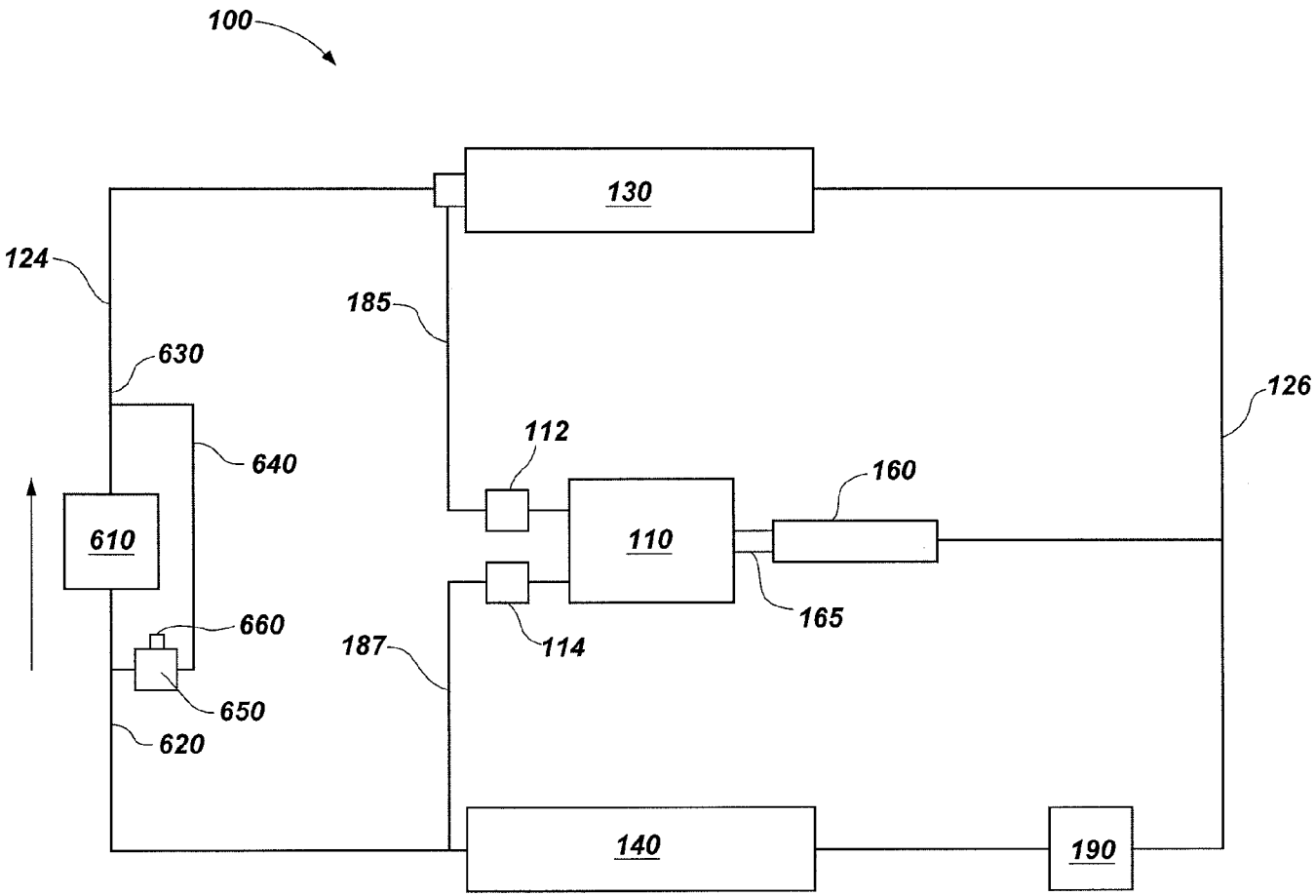
FIG. 6A is a block diagram of a heat transfer system that includes a mechanical pump.

Referring to FIG. 6A, in another implementation, the heat transfer system 100 includes a mechanical pump 610. An example design of a heat transfer system that includes a mechanical pump is described in U.S. Patent Application Publication No. 2005/0061487, filed Jul. 14, 2004, now U.S. Pat. No. 7,549,461, issued Jun. 23, 2009, which is hereby incorporated herein by reference in its entirety.

In the example shown in FIG. 6A, the mechanical pump 610 is a liquid pump and is positioned in series with the liquid line 124. A bypass line 640 connects an upstream side 620 of the mechanical pump to a downstream side 630 of the mechanical pump 610. The bypass line 640 includes a bypass device 650 that prevents fluid from flowing through the bypass line 640 when the mechanical pump 610 is active. The bypass device 650 can include a switch 660.

The mechanical pump 610 can facilitate excess fluid flow to the primary evaporator 130 by pumping fluid from an upstream side 620 of the mechanical pump 610 to the downstream side 630. The excess fluid flow to the primary evaporator 130 can sweep NCG bubbles or vapor from the core 220 (FIGS. 2A-2C) of the evaporator 130. The pumping power of the mechanical pump 610 can be varied based on the amount of bubbles in the core 220 of the evaporator 130.

The bypass line 640 allows fluid to flow around the mechanical pump 610 rather than through the mechanical pump 610. For example, the bypass line 640 can be used when the mechanical pump 610 is malfunctioning or when the mechanical pump 610 is turned off to permit fluid to continue flow through the heat transfer system 100 and around the mechanical pump 610. The bypass line 640 includes the bypass device 650 that prevents fluid from flowing through the bypass line 640 unless the bypass device 650 is open. Thus, the bypass device 650 can be a valve that allows fluid to flow through the bypass line 640 only when the valve is open. For example, the bypass device 650 can be a gate valve.

The bypass device 650 can include a switch 660 configured to open and close the bypass device 650. The switch 660 also can be used to switch the heat transfer system 100 from active operation (e.g., with the mechanical pump 610 in operation) to passive operation (e.g., solely with capillary pumping and without the use of the mechanical pump 610). The switch 660 can be activated automatically in response to a detection of a failure of the mechanical pump 610. For example, the switch 660 can be part of a feedback system that detects a failure of the mechanical pump 610 and opens the bypass device 650 in response such that fluid flows through the bypass line 640 rather than through the mechanical pump 610. In other implementations, the switch 660 can open or close the bypass device 650 in response to a user input or a signal received from a computing device. In still other designs, the switch 660 can be activated remotely. The switch 660 can be internal to the bypass device 650. In some designs, the switch 660 can be a check valve such as those described above with respect to FIG. 1. In this implementation, the switch 660 opens in response to a pressure difference between the upstream side 620 and the downstream side 630.

Figure 6B:
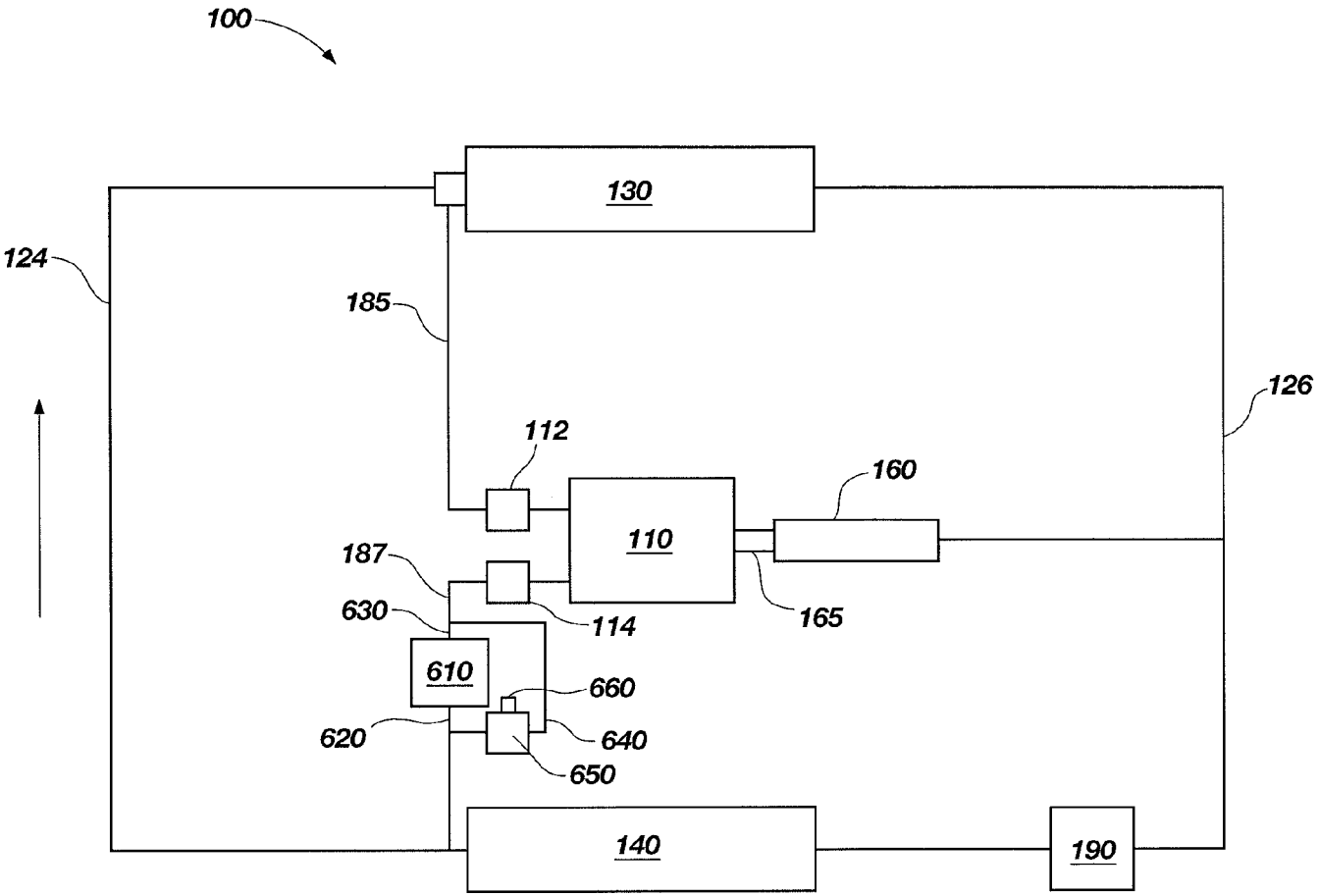
FIG. 6B is a block diagram of a heat transfer system that includes a mechanical pump.

Referring to FIG. 6B, the mechanical pump 610, the bypass line 640, the bypass valve 650, and the switch 660 can be located in series with the sweepage line 187. Generally, the sweepage line 187 includes a smaller flow rate of fluid compared to the liquid line 124 because the sweepage line 187 includes sweepage flow, whereas the liquid line 124 can include both sweepage flow from the sweepage line 187 and fluid output from the condenser 140. Thus, the design shown in FIG. 6B, the mechanical pump 610 can be smaller than in the design in which the mechanical pump 610 is in series with the liquid line 124.

Figure 7:
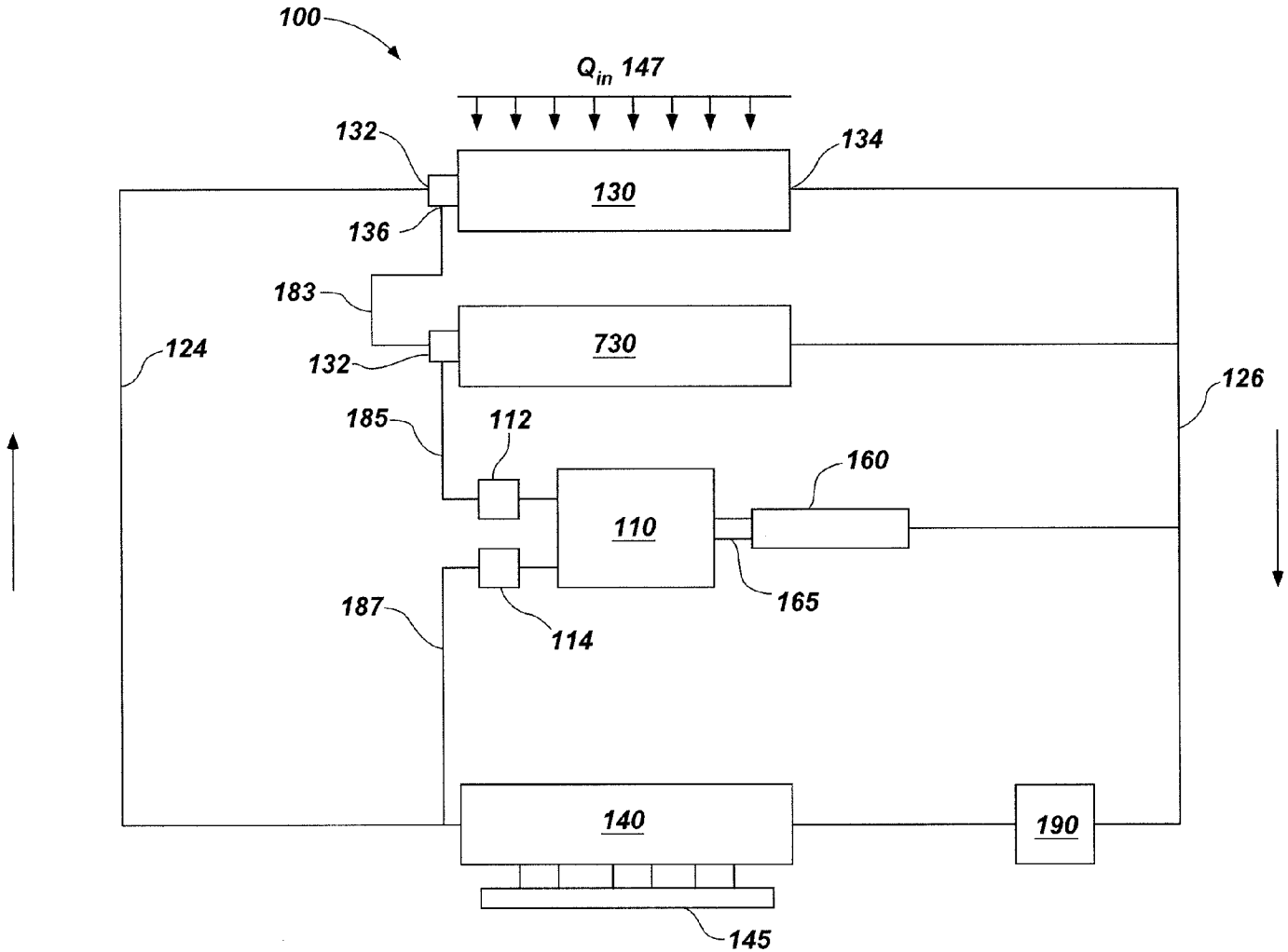
FIG. 7 is a block diagram of a heat transfer system that includes evaporators in a series configuration.

Referring to FIG. 7, another implementation of the heat transfer system 100 also includes one or more primary evaporators 730 in addition to the evaporator 130. In other implementations, fewer or additional primary evaporators can be used. In the implementation shown in FIG. 7, the evaporators 130 and 730 are three-port evaporators such as the three-port evaporator 130 described with respect to FIGS. 2A and 2B. Thus, the second primary evaporator 730 includes a liquid inlet, a vapor outlet, and a fluid outlet similar to the liquid inlet 132, the vapor outlet 134, and the fluid outlet 136 described with respect to the evaporator 130.

In the design shown in FIG. 7, the primary evaporators 130 and 730 are in a series configuration. In a series configuration, the liquid inlet 132 of one primary evaporator is coupled to the liquid line 124, while the liquid inlet 132 of each of the other primary evaporators is coupled to the fluid outlet 136 of another primary evaporator.

Figure 8:
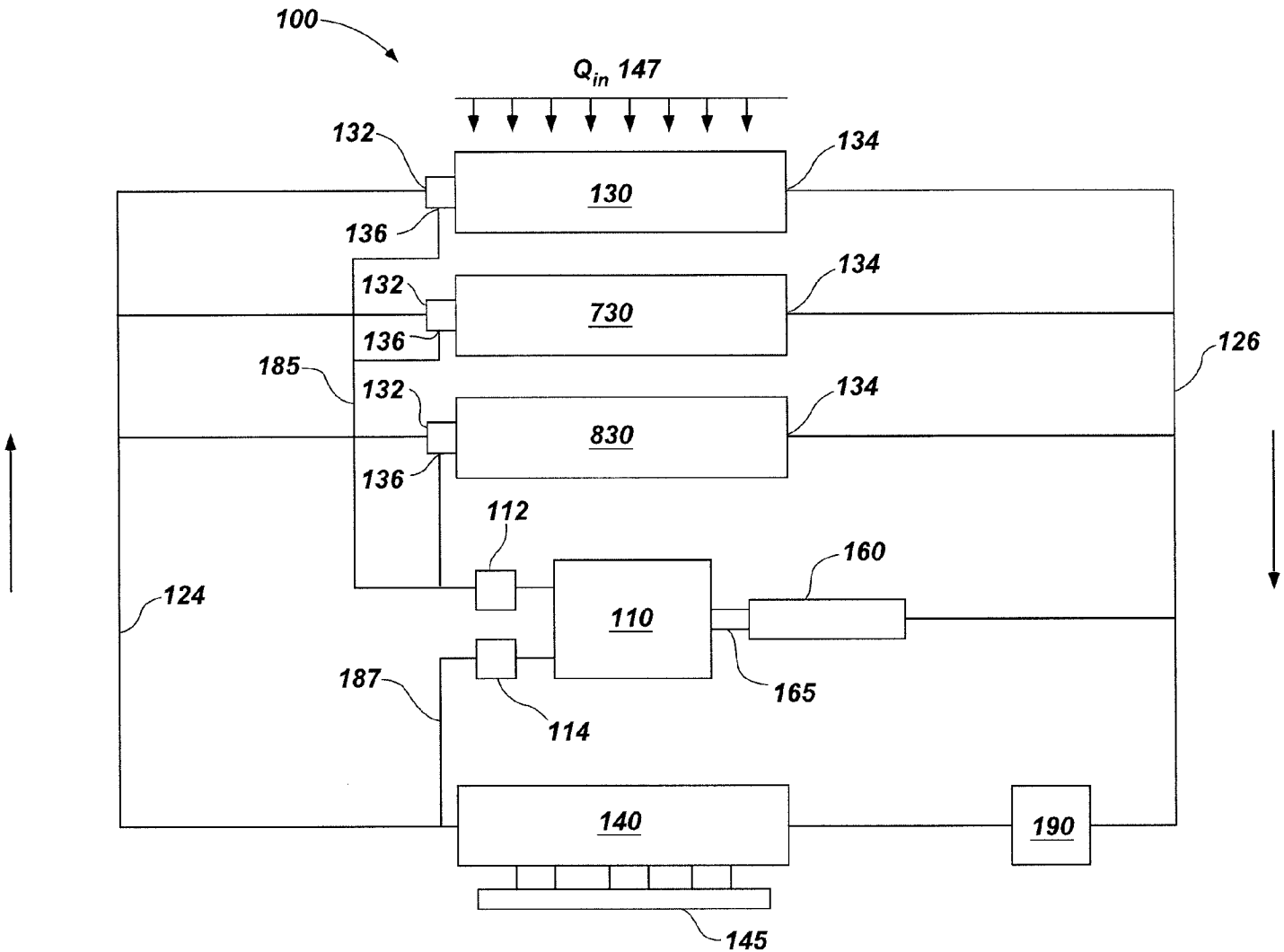
FIG. 8 is a block diagram of a heat transfer system that includes evaporators in a parallel configuration.

Referring to FIG. 8, another implementation of the heat transfer system 100 includes three primary evaporators 130, 730, and 830. In the implementation shown in FIG. 8, the three primary evaporators 130, 730, and 830 are arranged in a parallel configuration (relative to their liquid inlets 132), and the evaporators 130, 730, and 830 are three-port evaporators similar to the evaporator 130 described in FIGS. 2A and 2B. In a parallel configuration, the liquid inlets 132 of the evaporators 130, 730, and 830 are all connected to the liquid line 124. The vapor outlets 134 of the evaporators 130, 730, and 830 are all connected to the vapor line 126. In the implementation shown in FIG. 8, the evaporators 130, 730, and 830 are three-port evaporators as described with respect to FIGS. 2A and 2B. Thus, the liquid inlets 132 of the primary evaporators 130, 730, and 830 are coupled to the liquid line 124 and the vapor outlets 136 of the primary evaporators 130, 730, and 830 are coupled to the vapor line 126. The liquid outlets 134 of the primary evaporators 130, 730 and 830 are connected to the sweepage line 185.

The implementation shown in FIG. 8 includes three primary evaporators 130, 730, and 830. However, in other implementations, fewer or additional primary evaporators can be used.

Figure 9:
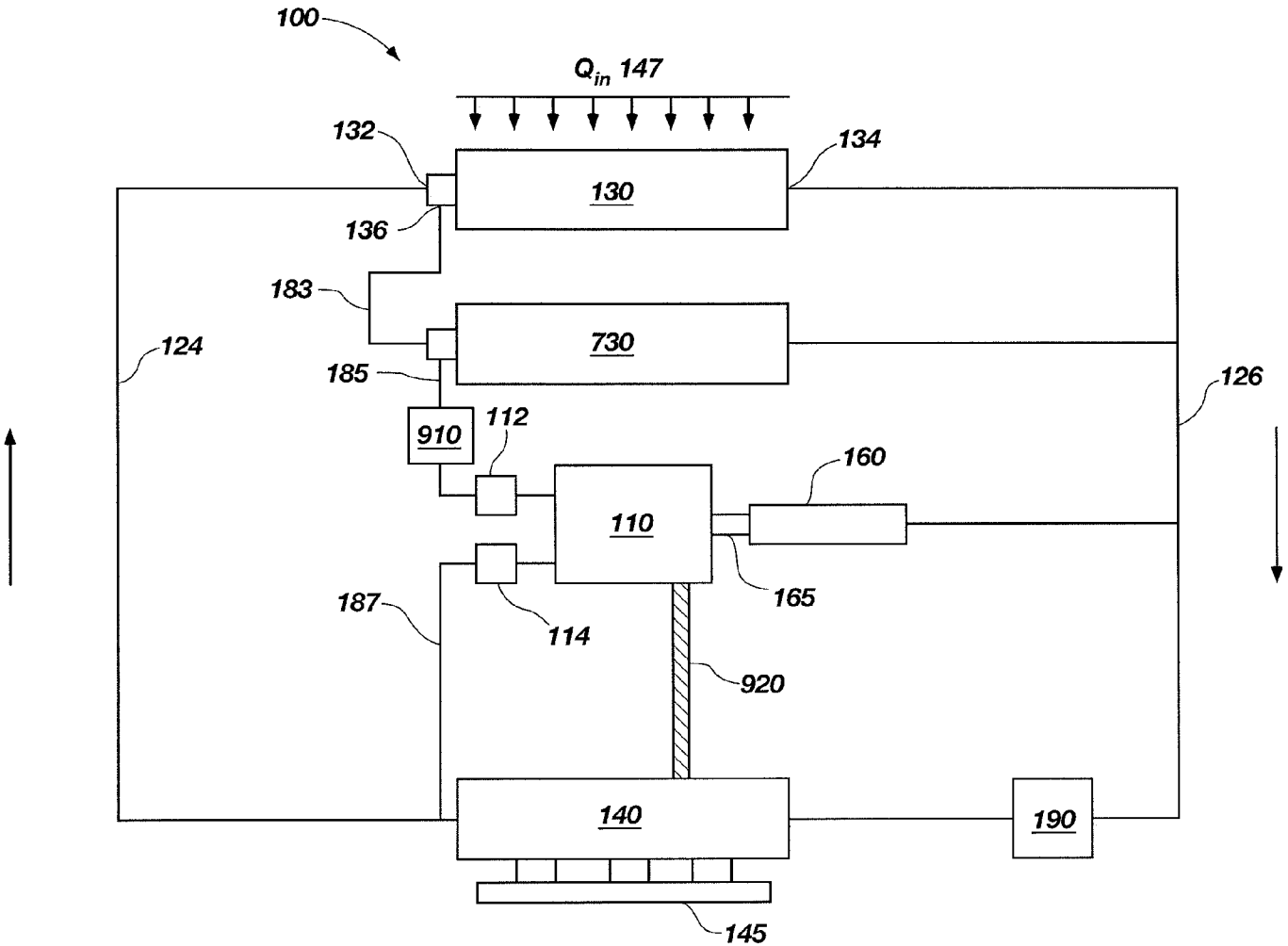
FIG. 9 is a block diagram of a heat transfer system.

Referring to FIG. 9, an implementation of the heat transfer system 100 includes a reservoir bypass heat exchanger 910 positioned between the reservoir 110 and the evaporator 730. In another implementation, the bypass heat exchanger 910 can be positioned between the evaporator 130 and the evaporator 730. In this implementation, a second bypass heat exchanger (not shown) is positioned between the evaporator 730 and the reservoir 110. Alternatively, or additionally, the heat transfer system 100 can include a shunt 920 that thermally couples the condenser 140 and the reservoir 110. The shunt 920 can provide cold bias to the reservoir 110 and can be made of a thermally conductive material. For example, the shunt 920 can be made from a metal such as copper or aluminum. In another example, the shunt 920 can be a carbon composite.

The bypass heat exchanger 910 cools vapor present in the fluid flowing in the sweepage line 185 such that vapor in the sweepage line 185 is condensed into liquid. Similarly, the shunt 920 cools the fluid in the reservoir 110 and condenses vapor in the reservoir 110 into liquid. In other designs, the shunt 920 can be replaced, or supplemented, by a thermoelectric cooler coupled to the reservoir 110.

Figure 10A:
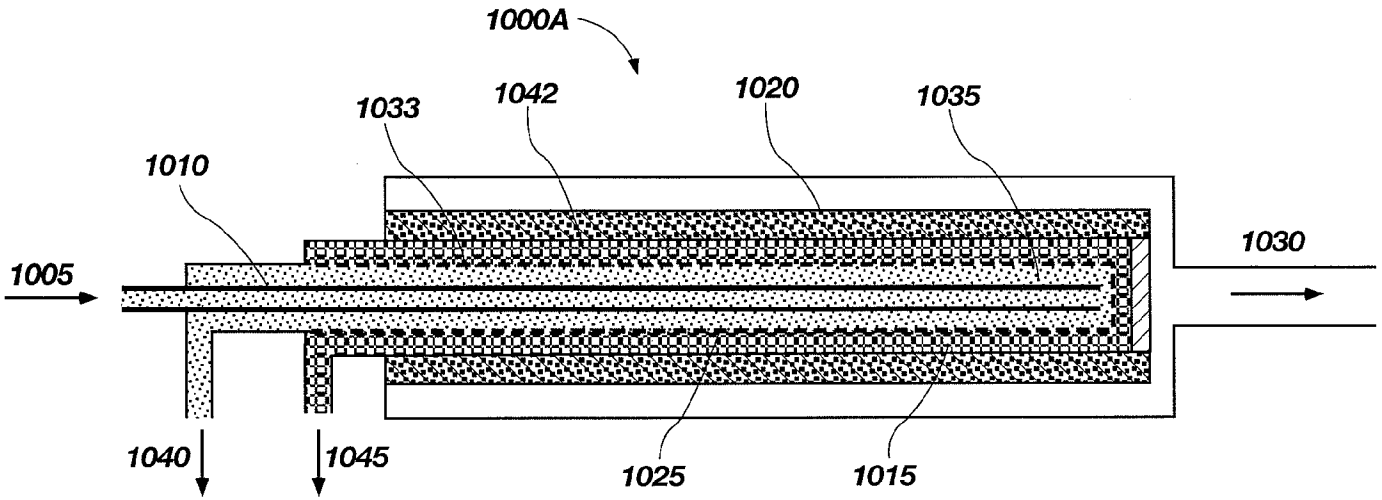
FIG. 10A is a cross-sectional view of a four-port evaporator that can be used in the heat transfer systems of FIGS. 1, 5-9, 11, and 12.

Referring to FIG. 10A, in another implementation, the primary evaporator 130 (FIGS. 1, 2A, and 2B) is designed as a four-port evaporator 1000A. Such a design is described in U.S. Pat. No. 6,889,754, which issued on May 10, 2005. Briefly, and with emphasis on aspects that differ from the three-port evaporator configuration, liquid flows into the evaporator 1000A through a fluid inlet 1005, through a bayonet 1010, and into a core 1015. The liquid within the core 1015 enters a primary wick 1020 and evaporates, forming vapor that is free to flow along vapor grooves 1025 and out a vapor outlet 1030 into the vapor line 126 (FIG. 1). A secondary wick 1033 within the core 1015 separates liquid within the core 1015 from vapor or bubbles in the core 1015 (that are produced when liquid in the core 1015 heats). The liquid carrying bubbles formed within a first fluid passage 1035 inside the secondary wick 1033 flows out of a fluid outlet 1040 and the vapor or bubbles formed within a vapor passage 1042 positioned between the secondary wick 1033 and the primary wick 1020 flow out of a two-phase outlet 1045.

Figure 10B:
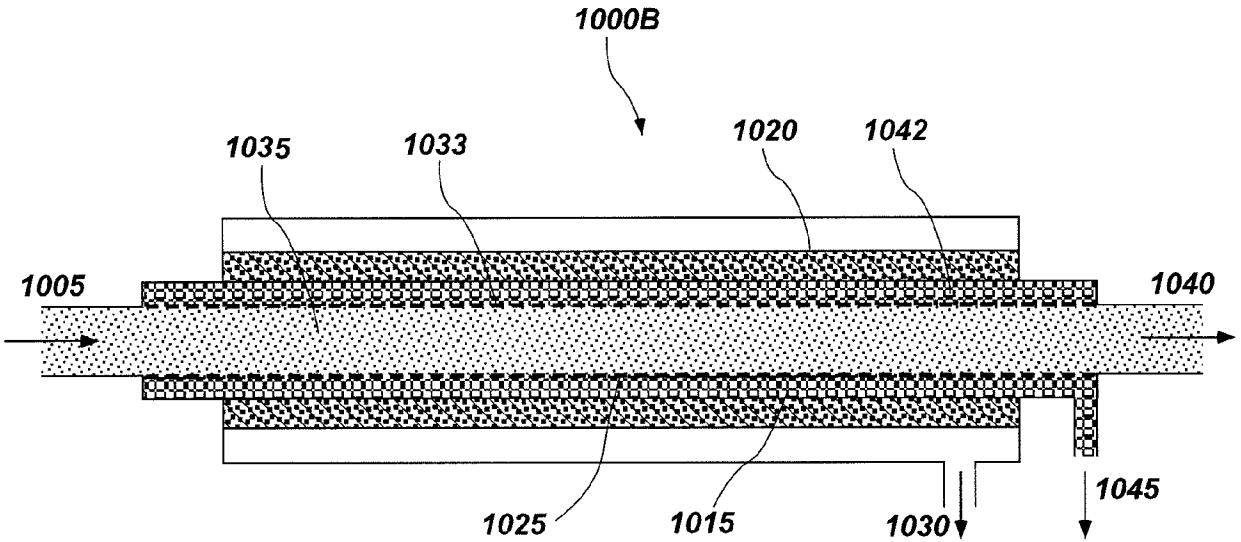

Referring to FIG. 10B, in another implementation, the primary evaporator 130 (FIGS. 1, 2A and 2B) is designed as a flow-through four-port evaporator 1000B. Briefly, and with emphasis on aspects that differ from the configuration shown in FIG. 10A, liquid flows into the evaporator 1000B through a fluid inlet 1005, and into a core 1015. The liquid within the core 1015 enters a primary wick 1020 and evaporates, forming vapor that is free to flow along vapor grooves 1025 and out a vapor outlet 1030 into the vapor line 126 (FIG. 1). A secondary wick 1033 within the core 1015 separates liquid within the core 1015 from vapor or bubbles in the core 1015 (that are produced when liquid in the core 1015 heats). The liquid carrying bubbles formed within a fluid passage 1035 inside the secondary wick 1033 flows out of a fluid outlet 1040 and the vapor or bubbles formed within a vapor passage 1042 positioned between the secondary wick 1033 and the primary wick 1020 flow out of a two-phase outlet 1045.

Figure 11:
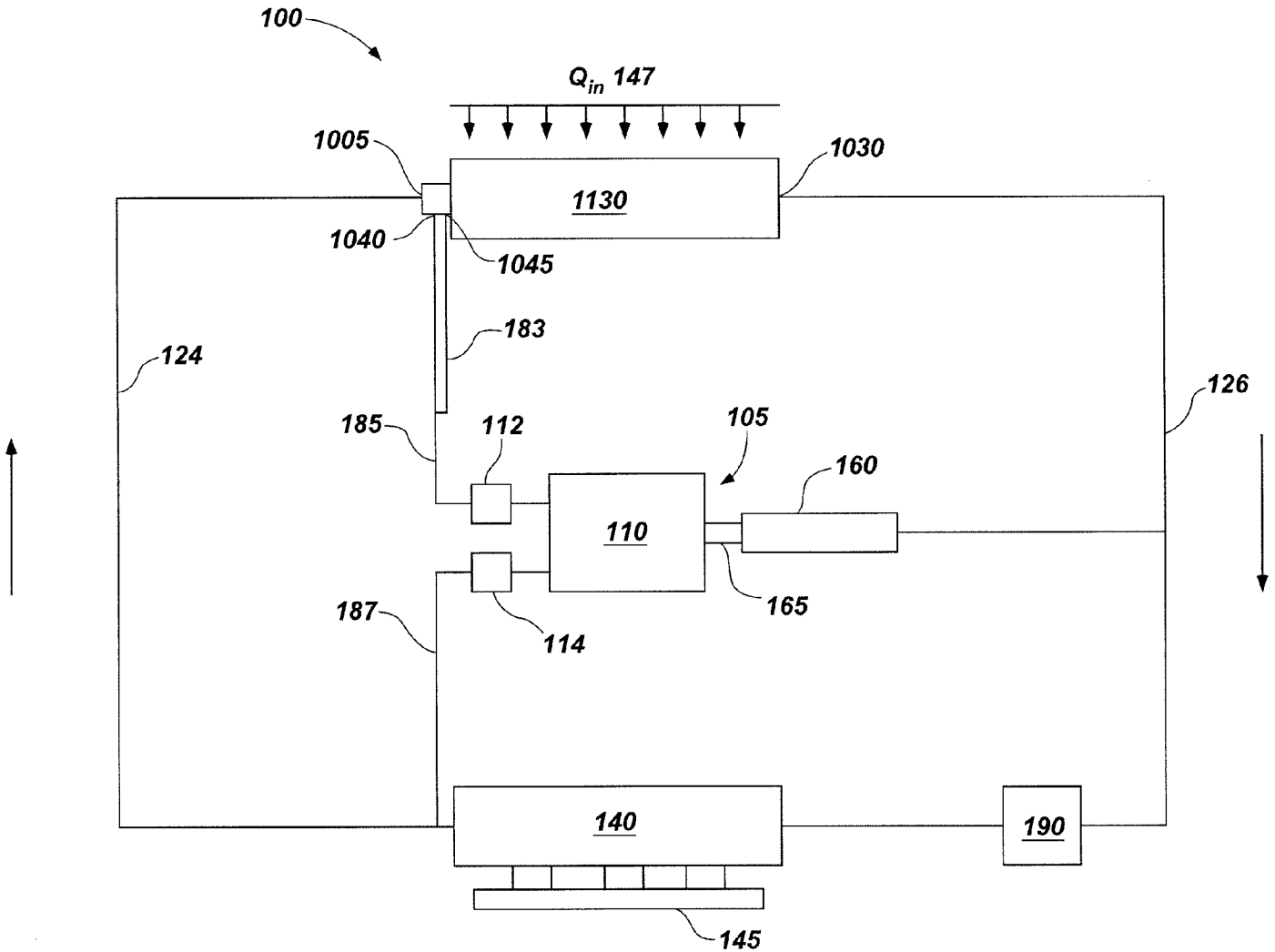
FIG. 11 is a block diagram of a heat transfer system that includes a four-port evaporator.

Referring also to FIG. 11, an implementation of the heat transfer system 100 includes a four-port primary evaporator 1130 such as the four-port evaporator 1000 described above. The four-port primary evaporator 1130 is similar to the three-port primary evaporator 130 described with respect to FIG. 1, except the evaporator 1130 includes a two-phase outlet 1045, a fluid inlet 1005, a vapor outlet 1030, and a fluid outlet 1040. The fluid outlet 1040 and the two-phase outlet 1045 are connected to the sweepage lines 185 and 183, respectively. The four-port evaporator 1130 is coupled to the condenser 140 by a liquid line 124 and a vapor line 126. Similar to the three-port evaporator implementations shown in FIGS. 7 and 8, the heat transfer system 100 may include more than one four-port evaporator, and the four-port evaporators can be arranged in a serial or parallel orientation.

In the implementations shown in FIG. 11, the sweepage line 183 joins the sweepage line 185 prior to reaching the flow-directional device 112. In other implementations, the sweepage line 183 can connect to the reservoir 110 through a third flow-directional device that is similar to the flow directional device 112.

Figure 12:
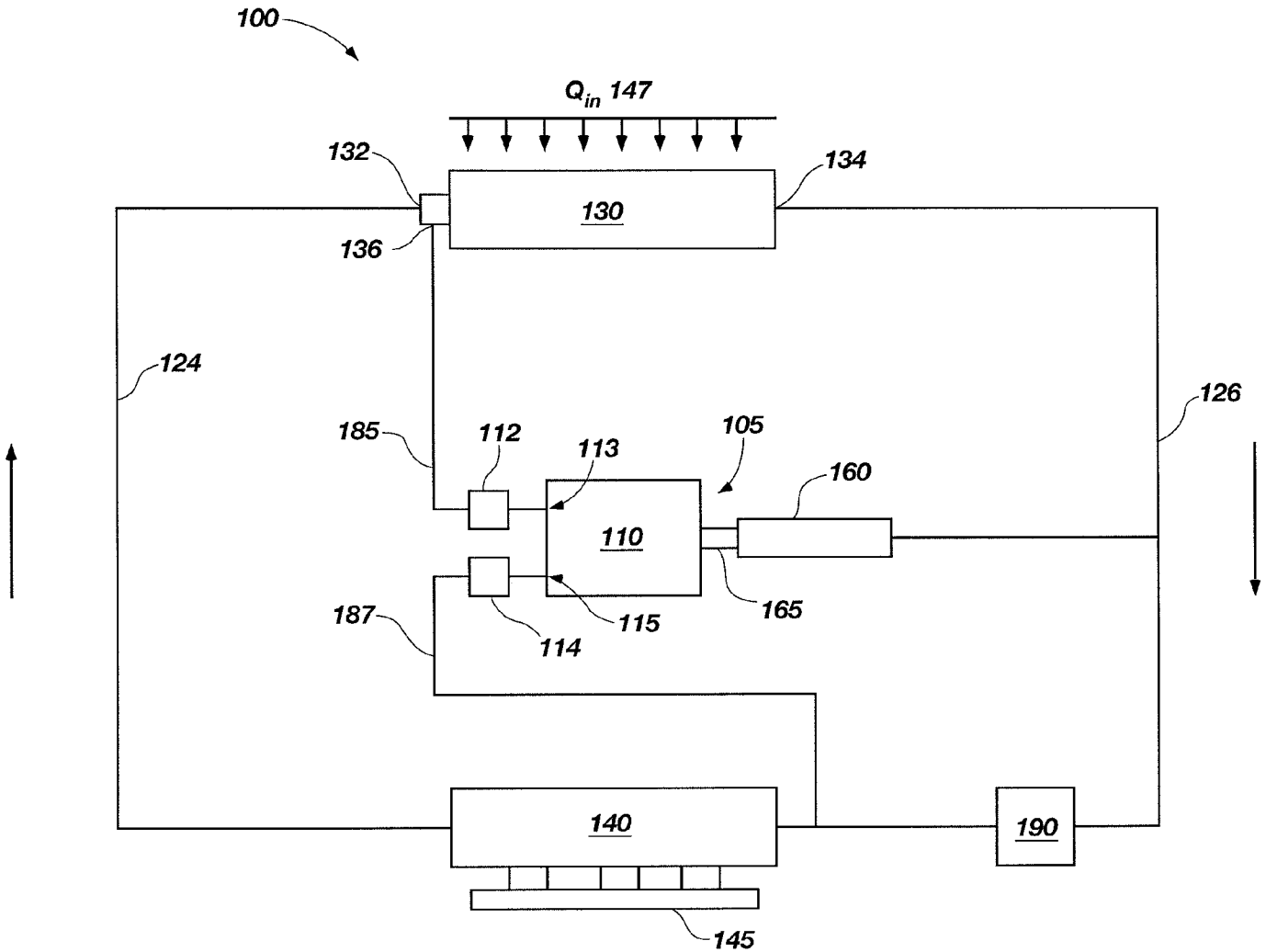
FIG. 12 is a block diagram of a heat transfer system.

Referring to FIG. 12, an implementation of the heat transfer system 100 couples the sweepage line 187 to the vapor line 126 between the condenser 140 and the back pressure regulator 190. In this implementation, fluid in the sweepage line 187 enters the vapor line 126 and is swept into the condenser 140 where it can be condensed into liquid.

Figure 13:
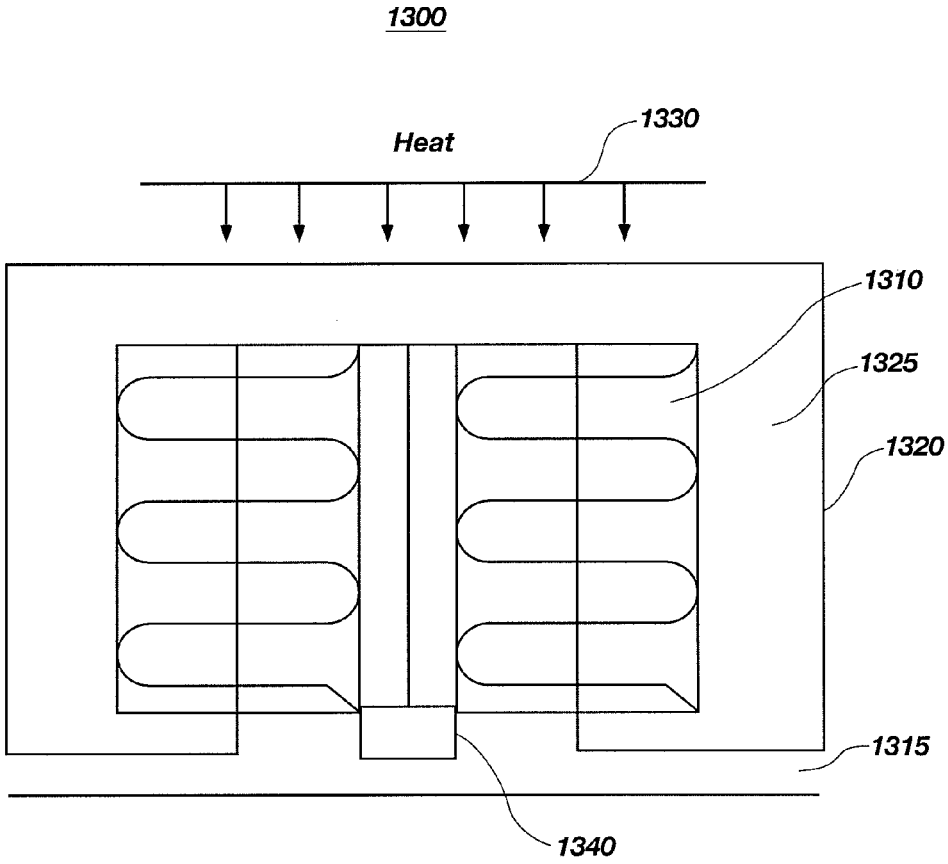
FIG. 13 is a block diagram of an active valve that can be used in the heat transfer systems of FIGS. 1, 5-9, 11, and 12.

Referring to FIG. 13, an active valve 1300 can be used as one or more of the flow-directional devices 112 and 114, as described above with respect to FIG. 7. In the design shown in FIG. 13, the active valve 1300 includes bellows 1310 within an enclosure 1320. The enclosure 1320 is filled with a fluid 1325. The bellows 1310 open to the heat transfer system 100, for example, the bellows 1310 can open to a sweepage line 1315. The sweepage line 1315 can be, for example, the sweepage line 185 or the sweepage line 187, and hold system fluid when the bellows 1310 are expanded. Heat can be applied to the enclosure 1320 through a heat source 1330. Heating the enclosure 1320 causes a pressure difference between the fluid 1325 in the enclosure 1320 and the system fluid in the bellows 1310. This pressure difference can cause the bellows 1310 to constrict and the plunger 1340 to extend into the sweepage line 1315, which prevents fluid flow through the sweepage line 1315.

Other implementations are within the scope of the following claims. For example, the condenser 140 and the heat sink 145, as described above, can be designed as an integral system. The flow-directional devices 112 and 114 can be implemented with any type of valve, or other devices, that controls fluid flow. The mechanical pump 610 (FIG.6A) can be used in the series evaporator configuration shown in FIG. 7, in the parallel evaporator configuration shown in FIG. 8, and/or with the four-port evaporators 1000A, 1000B shown in FIGS. 10A and 10B, respectively.

What is claimed is:

1. A heat transfer system comprising:

a primary evaporator having a liquid inlet port, a vapor outlet port, and a fluid outlet port;

a condenser coupled to the primary evaporator by a liquid line coupled to the liquid inlet port of the primary evaporator and a vapor line coupled to the vapor outlet port of the primary evaporator;

a secondary evaporator connected to the primary evaporator through a sweepage line; and a reservoir system comprising:

a reservoir coupled to the fluid outlet port of the primary evaporator through a sweepage line and positioned between the primary evaporator and the secondary evaporator, wherein the secondary evaporator is positioned between the reservoir and the condenser;

a first flow directional device positioned between the fluid outlet port of the primary evaporator and the reservoir for restricting fluid flow such that fluid flows into the reservoir from the primary evaporator; and a second flow directional device coupled to a liquid outlet port of the reservoir for restricting fluid flow such that fluid flows out of the reservoir through the liquid outlet port of the reservoir.

2. The system of claim 1, wherein the first flow directional device includes a first valve and the second flow directional device includes a second valve.

3. The system of claim 2, wherein one or more of the first valve and the second valve are one-way check valves.

4. The system of claim 2, wherein one or more of the first valve and the second valve are gate valves.

5. The system of claim 1, wherein one or more of the first and second flow directional devices are external to a body of the reservoir.

6. The system of claim 1, wherein one or more of the first and second flow directional devices are internal to a body of the reservoir.

7. The system of claim 1, wherein the primary evaporator further comprises a liquid channel coupled to the fluid outlet port of the primary evaporator.

8. The system of claim 7, wherein the fluid outlet port of the primary evaporator includes:

a first outlet configured to remove at least vapor from the primary evaporator, and a second outlet configured to remove fluid from the primary evaporator.

9. The system of claim 8, wherein a capillary barrier separates the first outlet of the fluid output port of the primary evaporator from the second outlet of the fluid output port of the primary evaporator.

10. The system of claim 9, wherein the capillary barrier is a wick or a screen.

11. The system of claim 7, further comprising a second primary evaporator, wherein the second primary evaporator includes a liquid inlet, and the liquid inlet of the second primary evaporator is coupled to the fluid outlet port of the primary evaporator through another sweepage line.

12. The system of claim 7, further comprising a second primary evaporator, wherein the second primary evaporator includes a liquid inlet, and the liquid inlet of the second primary evaporator is coupled to the liquid line.

13. The system of claim 1, further comprising a mechanical pump coupled to an output of the condenser and to the liquid inlet port of the primary evaporator, the mechanical pump being configured to receive excess fluid from the condenser and to provide excess fluid to the primary evaporator.

14. The system of claim 13, wherein the mechanical pump is positioned in series with the liquid line.

15. The system of claim 13, wherein the mechanical pump is positioned between the condenser and the reservoir system.

16. The system of claim 13, further comprising:

a bypass line configured to direct fluid around the mechanical pump, the bypass line including a first side, a second side, and a bypass device, wherein:

the first side is coupled upstream of a fluid entrance of the mechanical pump, the second side is coupled downstream of a fluid exit of the mechanical pump, and the bypass device is configured to control fluid flow through the bypass line.

17. The system of claim 16, wherein the bypass device includes a switch.

18. The system of claim 17, wherein the switch is a check valve.

19. The system of claim 17, wherein the switch is an active valve.

20. The system of claim 1, further comprising a power source configured to apply power to the secondary evaporator such that excess fluid is provided to the primary evaporator.

21. The system of claim 1, wherein at least one of the first flow directional device and the second flow directional device comprises:

an open/close valve; and a feedback system coupled to the open/close valve to control operation of the open/close valve.

22. The system of claim 21, wherein the feedback system comprises:

a sensing system coupled to the at least one of the first flow directional device and the second flow directional device for sensing characteristics associated with fluid flow through the at least one of the first flow directional device and the second flow directional device, and for producing a signal representative of the characteristics; and an actuator configured to operate the open/close valve in response to the signal from the sensing system.

23. The system of claim 22, wherein the open/close valve includes a gate valve.

24. The system of claim 22, wherein:

the sensing system senses a pressure difference of the fluid at the at least one of the first flow directional device and the second flow directional device, and the actuator operates in response to the signal indicating that the sensed pressure difference is greater than a predetermined value.

25. The system of claim 24, wherein the sensing system includes a first sensor coupled to the first flow directional device and a second sensor coupled to the second flow directional device.

26. The system of claim 25, wherein one or more of the first and second sensors are temperature sensors.

27. The system of claim 1, wherein the secondary evaporator of the reservoir system is fluidly coupled to the reservoir through another liquid outlet port, the secondary evaporator for flowing fluid from the reservoir to the vapor line.

28. The system of claim 1, wherein the first flow directional device is inside a body of the reservoir.

29. The system of claim 1, wherein the second flow directional device is inside a body of the reservoir.

30. The system of claim 1, wherein the first flow directional device is outside a body of the reservoir.

31. The system of claim 1, wherein the second flow directional device is outside a body of the reservoir.

32. The system of claim 1, wherein the first and second flow directional devices are one-way check valves.

33. A method for heat transfer comprising:

providing a heat transfer system comprising:

a primary evaporator having a liquid inlet port, a vapor outlet port, and a fluid outlet port;

a condenser coupled to the primary evaporator by a liquid line coupled to the liquid inlet port of the primary evaporator and a vapor line coupled to the vapor outlet port of the primary evaporator;

a secondary evaporator connected to the primary evaporator through a sweepage line; and a reservoir system comprising:

a reservoir coupled to the fluid outlet port of the primary evaporator through a sweepage line and positioned between the primary evaporator and the secondary evaporator, wherein the secondary evaporator is positioned between the reservoir and the condenser;

a first flow directional device positioned between the fluid outlet port of the primary evaporator and the reservoir for restricting fluid flow such that fluid flows into the reservoir from the primary evaporator; and a second flow directional device coupled to a liquid outlet port of the reservoir for restricting fluid flow such that fluid flows out of the reservoir through the liquid outlet port of the reservoir;

sweeping fluid from the primary evaporator to a first port of the reservoir;

limiting fluid from flowing into the primary evaporator from the reservoir through the first port;

discharging liquid from the liquid outlet port of the reservoir; and limiting liquid flowing into the reservoir through at least the liquid outlet port of the reservoir.

34. The method of claim 33, wherein sweeping fluid from the primary evaporator includes sweeping one or more of vapor and non-condensable gas bubbles from the primary evaporator.

35. The method of claim 33, wherein the first flow directional device comprises a check valve, and wherein limiting fluid from flowing into the primary evaporator from the reservoir through the first port includes flowing fluid through the check valve positioned outside a body of the reservoir and coupled to the first port of the reservoir.

36. The method of claim 33, wherein the second flow directional device comprises a check valve, and wherein limiting liquid flow flowing into the reservoir through at least the liquid outlet port includes flowing fluid through the check valve positioned outside a body of the reservoir and coupled to the liquid outlet port of the reservoir.

37. The method of claim 33, wherein the first flow directional device comprises a check valve, and wherein limiting fluid from flowing into the primary evaporator from the reservoir through the first port includes flowing fluid through the check valve positioned inside a body of the reservoir and coupled to the first port of the reservoir.

38. The method of claim 33, wherein the second flow directional device comprises a check valve, and wherein limiting liquid flowing into the reservoir through at least the liquid outlet port includes flowing fluid through the check valve positioned inside a body of the reservoir and coupled to the liquid outlet port of the reservoir.

39. The method of claim 33, further comprising:

supplying liquid from the condenser to the liquid inlet portion of the primary evaporator;

discharging vapor from the vapor outlet port of the primary evaporator to the vapor line connected to the condenser;

heating the secondary evaporator fluidly coupled to the reservoir such that liquid is swept from the fluid outlet port of the primary evaporator to the first port of the reservoir; and discharging vapor from the secondary evaporator into the vapor line.

40. The method of claim 39, wherein the fluid is swept from the fluid outlet port of the primary evaporator by a mechanical pump.

41. The method of claim 33, wherein the fluid is swept from the condenser to the primary evaporator by a mechanical pump.

* * * * *